US011375776B1

(12) United States Patent
Ben-Arie

(10) Patent No.: US 11,375,776 B1
(45) Date of Patent: Jul. 5, 2022

(54) BUTTON FASTENING KIT

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

(21) Appl. No.: 17/562,042

(22) Filed: Dec. 27, 2021

(51) Int. Cl.
*A44B 1/28* (2006.01)
*A44B 1/42* (2006.01)
*A44B 17/00* (2006.01)

(52) U.S. Cl.
CPC ..... *A44B 1/28* (2013.01); *A44B 1/42* (2013.01); *A44B 17/0005* (2013.01); *A44B 17/007* (2013.01); *A44B 17/0035* (2013.01); *A44B 17/0052* (2013.01)

(58) Field of Classification Search
CPC ..... A44B 1/28; A44B 1/42; A44B 17/0005; A44B 17/0035; A44B 17/0052; A44B 17/007
See application file for complete search history.

(56) References Cited

U.S. PATENT DOCUMENTS 1,277,595 A * 9/1918 Jaffe ..... A44B 1/34 24/108
3,623,192 A * 11/1971 Papazian ..... A44B 1/34 411/510
3,982,013 A 9/1976 Katsuda
4,033,012 A 7/1977 Kramer
4,194,272 A * 3/1980 Taffurelli ..... A44B 1/34 411/510
4,512,063 A 4/1985 Fukuroi
4,662,034 A * 5/1987 Cunningham ..... A44B 1/28 24/94
4,751,780 A 6/1988 Trolltsch et al.
4,928,362 A 5/1990 Collas
5,107,573 A * 4/1992 Zhang ..... A44B 1/32 24/708
5,575,043 A 11/1996 Candotti
5,584,104 A * 12/1996 Stuart ..... A44B 1/185 24/104
5,940,940 A 8/1999 Tanikoshi
5,975,398 A 11/1999 Evans
6,702,162 B1 * 3/2004 Hassid ..... A41H 37/008 223/1
8,241,308 B2 * 8/2012 Kortenbach ..... A61B 17/068 606/220
8,522,404 B2 * 9/2013 Matei ..... A44B 1/28 24/104

(Continued)

*Primary Examiner* — David M Upchurch

(57) ABSTRACT

The kit comprises a fastening structure and an anchoring structure. The fastening structure includes two vertical poles which are connected at their top ends by a horizontal bar and are inserted into two apertures of the button. The lower ends of the poles are attached to terminal elements. The anchoring structure comprises two trapping mechanisms which are configured to trap the terminal elements and to prevent them from detachment once they fully enter the mechanisms. The user places the fastening structure with the button above the cloth at the desired location and places the trapping mechanisms below the cloth opposite to the terminal elements. Next, the user pushes the poles downwards pierces the cloth and permanently traps the terminal elements by fully inserting them into the trapping mechanisms. The user can create a buttoning gap by installing two spacing rings on the poles between the button and the cloth.

13 Claims, 5 Drawing Sheets

(56) References Cited

U.S. PATENT DOCUMENTS

| | | | | |
|---|---|---|---|---|
| 8,938,861 | B1 | 1/2015 | McLendon | |
| 9,820,520 | B2 | 11/2017 | Bolen | |
| 9,861,167 | B2 * | 1/2018 | Shirai | A44B 1/34 |
| 10,004,299 | B2 | 6/2018 | Maussen | |
| 10,070,697 | B1 * | 9/2018 | Melgoza | A44C 3/001 |
| D842,165 | S * | 3/2019 | Marin | D11/228 |
| 10,455,901 | B2 * | 10/2019 | Marin | A44B 1/34 |
| 2005/0188510 | A1 | 9/2005 | Retamal | |
| 2010/0236029 | A1 * | 9/2010 | Mattei | A44B 1/28 24/114.4 |

* cited by examiner

BUTTON FASTENING KIT

CROSS-REFERENCE TO RELATED APPLICATIONS

Not Applicable.

FEDERALLY SPONSORED RESEARCH

Not Applicable.

SEQUENCE LISTING OR PROGRAM

Not Applicable.

TECHNICAL FIELD

The present invention relates to Kits for Buttons Fastening to Garment Cloths.

PRIOR ART

Traditionally buttons are attached to garments by sewing threads. However, sewing buttons is quite slow and laborious. Furthermore, threaded buttons tend to detach and fall frequently. Most garment owners don't know how to refasten and sew fallen buttons. Hence, a Kit for simpler, faster and more robust button re-attachment could be quite useful and can yield a notable improvement. In our search we have found several inventions of button assemblies that were configured for fast button attachment but all of them are not designed for button reattachment. In addition, they are dissimilar to our invention both in their structures and in their principles of operation. Most, if not all of these attachment assemblies rely on some sort of metallic pedestal crimping in order to attach the button to the garment cloth. In U.S. Pat. No. 4,033,012 (Jul. 5 1977) to Kramer et al. teaches a metallic button held by a metallic pedestal that is stapled to the garment cloth by a four legged metallic staple that is crimped to hold the pedestal. In U.S. Pat. No. 8,522,404 (Sep. 3, 2013) Matei teaches a button which can be tilted because it is attached to an elongated metallic shaft with ball attached at one end. The ball is housed in a ball bearing cavity included in the mounting base attached to the garment. In US 2005/0188510 (Sep. 1, 2005) Retamal teaches a button attached to an elongated serrated metal shaft which fits into a serrated metal nut attached to the garment. In U.S. Pat. No. 4,751,780 (Feb. 25 1986) Fukuroi teaches a metal button which is attached to a mounting base by a crimped metal nail. In U.S. Pat. No. 4,512,063 (Apr. 23, 1985) Fukuroi teaches a metal button attachment to a base by a metal rivet. In U.S. Pat. No. 5,575,043 (Nov. 19, 1996) Candotti also teaches a metal button attachment to a base by a metal rivet. In U.S. Pat. No. 4,928,362 (May 29, 1990) Collas proposes to mount a metallic button on a metallic shank which is connected to a disk beneath the garment cloth. In U.S. Pat. No. 5,940,940 (Aug. 24, 1999) Tanikoshi teaches a button mounting by crimping a metal tubular rivet. In U.S. Pat. No. 5,975,398 (Nov. 2, 1999) Evans proposed attaching buttons to clothing by H shaped plastic studs which are inserted through the button holes into the clothing. In U.S. Pat. No. 9,820,520 (Nov. 21, 2017) Bolen teaches an attachment system with two parts one part attaches to the clothing side and the other part attaches to the button side and both parts are then coupled by a magnetic twist-lock mechanism. In U.S. Ser. No. 10/004,299 (Jun. 26, 2018) Maussen Teaches a tapered trapezoidal shape buttons which are connected to fabrics using sewing. IN U.S. Pat. No. 3,982,013 (Jul. 1 1975) Gould teaches a button attachment using a rivet with long serrated shaft that protrudes from the clothing and is attached to a button with fitting aperture. In U.S. Pat. No. 8,938,861 (Jan. 27, 2015) McLendon teaches a removably attachable button using a pair of U-shaped flexible pins with small hooks at their ends, which are inserted through the clothing and through the buttonholes.

All the above inventions are entirely dissimilar to our invention.

BRIEF SUMMARY OF THE INVENTION

I have several goals in inventing and developing the Button Assembly kit of which some feasible embodiments are illustrated in FIGS. 1-8. The goals are:

1. To develop a Button Assembly Kit which facilitates easy manual attachment of the button to a garment cloth without any need for sewing, threads or metal crimping.
2. To design Button assembly kit components which facilitate robust manual Button fastening without needing additional tools or machines.
3. To configure a fastening structure which can be attached swiftly, firmly and permanently to cloths.
4. To design an anchoring structure (i.e. a structure which anchors to the cloth) which fastens the button to the cloth by trapping the fastening structure that is tied to the button.
5. To include trapping mechanisms in the anchoring structure which are configured to trap and hold the fastening structure.
6. To design trapping mechanisms which can withstand without detachment strong pulling forces when applied to the button.
7. To design a button assembly which could be manufactured inexpensively in mass production from common elastic materials such as plastics.
8. To configure an anchoring structure that includes a trapping mechanism which exploits the resiliency of gates made of materials such as plastics to trap a terminal element which is attached to the fastening structure. Thereby, robustly tying the button to the garment cloth.
9. To facilitate easy buttoning by including with the fastening structure Spacing Rings which introduce a buttoning gap between the button and the clothing.
10. To configure piercing cones which are temporarily attached to the bottom face of the terminal elements and facilitate piercing of the garment cloth during manual attachment of the fastening structure to the garment cloth.
11. To consider the option of drilling guiding apertures in the cloth in order to facilitate piercing of the cloth by the terminal elements during manual attachment of the fastening structure to the cloth.

In order to achieve the objectives listed above, our method for button fastening to the garment cloth adopts the operational principle of tying the button to a fastening structure which includes at least two poles which are attached at their bottom ends to terminal elements. The fastening of the button to the cloth is facilitated by trapping the terminal elements using trapping mechanisms housed at the anchoring structure which is placed beneath the cloth. The trapping mechanisms use resilient gating technique where the action of trapping is initiated by a forceful intrusion of a terminal element into the aperture which houses the trapping mechanism. The intrusion of the terminal element bends a multiplicity of resilient flaps (i.e. a multiplicity of resilient gates) which reside at the entrance of the aperture housed at the anchoring structure. Next, the bent resilient gating flaps are configured to be released when the terminal element is pushed further down and fully inserted into the aperture below the tips of the maximally bended flaps. Once the terminal element reaches below the tips of the maximally bended flaps, the flaps are released. Next, the released flaps unbend due to their elasticity and turn upwards until they end up resting on the pole above the terminal element by which they are trapping the terminal element inside the aperture inside the anchoring structure and preventing it from moving upwards. When the terminal elements attached to the fastening structure are pushed downwards into the anchoring structure apertures which house the trapping mechanisms, all the terminal elements attached to the poles of the fastening structure are simultaneously trapped. By which the button is fastened to the anchoring structure and to the cloth.

The resilient gating flaps of the trapping mechanism is initially bent by a forceful intrusion of a terminal element (i.e. a hemisphere or a cylinder which are attached at the bottom end of a pole connected to the button). Initially, the downwards intrusion of the terminal element into the anchoring structure's aperture pushes and bends downwards the resilient multiplicity of flaps that are attached at the upper opening of the trapping mechanism's aperture housed at the anchoring structure. Next, the trapping mechanism is triggered shut when the terminal element is pushed further downwards into the anchoring structure, beyond the tips of the maximally bent multiplicity of flaps. At that instant, the multiplicity of flaps are released and unbend turning upwards due to their resiliency and end up resting diagonally on the pole above the terminal element. At this situation, the pole prevents further upwards unbending motion of the released multiplicity of flaps since the flaps ends are leaning diagonally on the pole. At this point, the multiplicity of flaps trap the terminal element inside the aperture in the anchoring structure because they prevent the terminal element from retracting upwards. The button is also trapped since it is attached to the pole which is attached to the trapped terminal element. While the multiplicity of flaps are diagonally resting on the pole above the terminal element's upper side, the flaps are prevented from turning further upwards since their ends are diagonally resting on the pole. Hence, the multiplicity of resilient flaps are configured to prevent the terminal element from moving upwards thereby trapping the terminal element inside the anchoring structure.

The manual fastening of the button to the garment cloth is performed as follows: The button assembly is configured to be used for fast attachment of the button to the garment cloth by placing the anchoring structure below the garment cloth such that the anchoring structure's apertures are facing a lower side of the garment cloth while placing the fastening structure at an upper side of the garment cloth such that its attached terminal elements are situated opposite the anchoring structure's apertures. Next, manually pushing downwards the fastening structure from the upper side of the garment doth is configured to pierce the garment cloth by the terminal elements lower sides. Further pushing downwards insert the terminal elements into the anchoring structure's apertures which are situated beneath the lower side of the garment cloth. Inserting the terminal elements downwards through the anchoring structure apertures is configured to bend the multiplicity of flaps and to trap the terminal element inside the anchoring structure apertures when the flaps unbend. At the completion of the terminal element insertion, it is trapped inside the anchoring structure since it is situated beneath the multiplicity of flaps which are diagonally resting on the pole above the terminal element. At that point, the trapped terminal elements which are attached to the fastening structure, are configured to prevent detachment and separation of the fastening structure from the anchoring structure and from the garment cloth. Thereby, completing the attachment of the button to the garment cloth by permanently attaching the fastening structure to the garment cloth.

BRIEF DESCRIPTION OF THE DRAWINGS

FIG. 4 shows the fastening structure already inserted into the button.

FIG. 5 shows the fastening structure already inserted into the button and the spacing rings installed beneath the button.

FIG. 6 shows the fastening structure already inserted into the button and already pierced the cloth while the spacing rings are installed beneath the button and above the cloth.

FIG. 7 shows the fastening structure already inserted into the button and already pierced the cloth while the spacing rings are installed beneath the button and above the cloth. In FIG. 7 the fastening structure is installed also in the anchoring structure's apertures activating the trapping mechanisms as well.

FIG. 8 shows the fastening structure already inserted into the button and already pierced the cloth while the spacing rings are installed beneath the button and above the cloth. In FIG. 8 the fastening structure is installed also in the anchoring structure's apertures activating the trapping mechanisms as well. In FIG. 8 the piercing cones were removed as well.

DETAILED DESCRIPTION OF THE DRAWINGS

Figure 1:
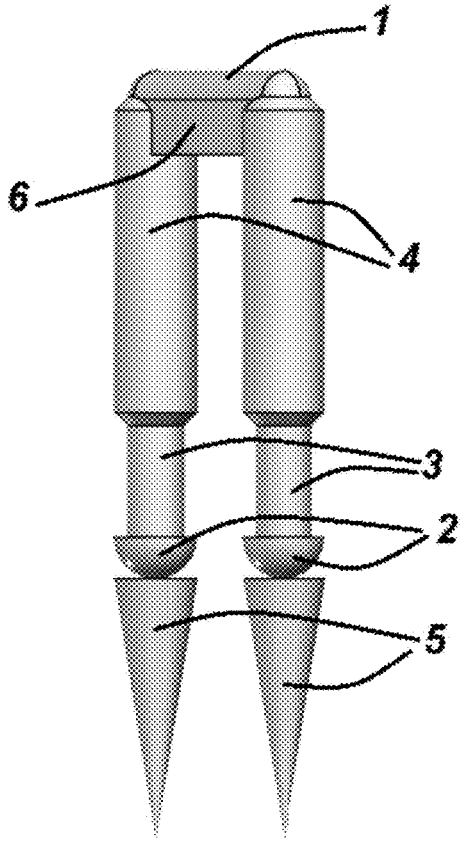
FIG. 1 displays a side view of an embodiment of the anchoring structure in 3D isometric drawing.

FIG. 1 displays a side view of an embodiment of the anchoring structure 1 in 3D isometric drawing. The left and right Poles are divided into two connected parts: the upper pole parts 4 and the lower pole parts 3. The left upper pole part 4 is attached at its bottom end to the top end of the left lower pole part 3 and together they are defined as the left pole in the Claims. The right upper pole part 4 is attached at its bottom end to the top end of the right lower pole part 3 and together they are defined as the right pole in the Claims. The top end of left Pole part 4 is attached to the left end of the horizontal bar 6. The top end of right Pole part 4 is attached to the right end of the horizontal bar 6. The horizontal bar 6 engages with the upper button 11 surface. The upper sides of the left and right terminal 2 are attached to the bottom ends of left lower pole part 3 and the right lower pole part 3 respectively. The left and right piercing cones 5 are temporarily attached at their top faces to the bottom faces of the left and right terminal elements 2 respectively. The piercing cones 5 facilitate piercing of the cloth by the terminal elements 2. The cones 5 are configured to be removed by the user after piercing.

Figure 2:
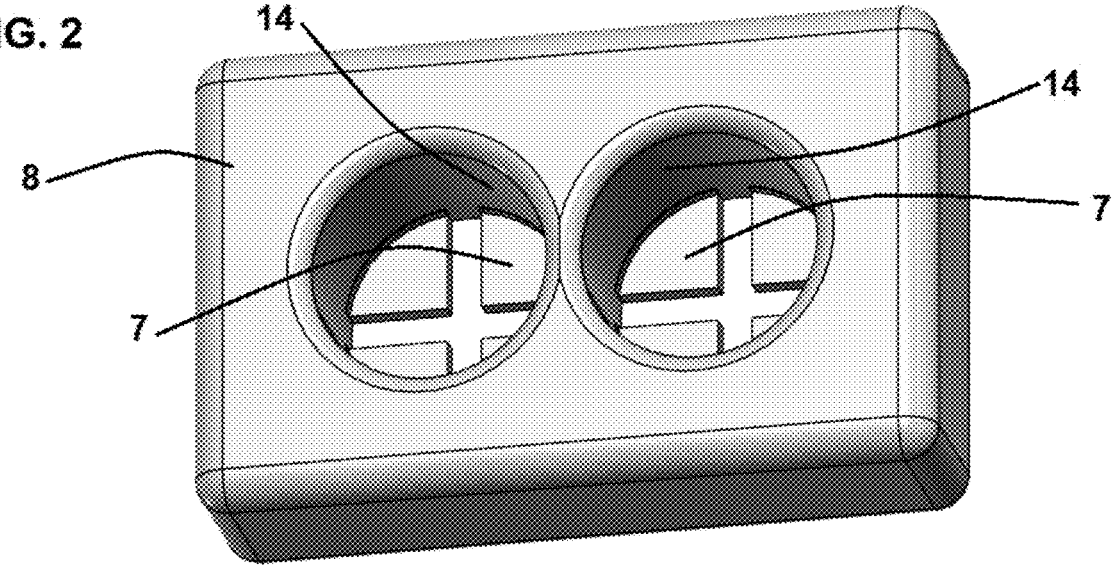
FIG. 2 Depicts in 3D isometric drawing a bottom view of an embodiment of the anchoring structure which includes two trapping mechanisms inside two apertures.

FIG. 2 Depicts in 3D isometric drawing a bottom view of an embodiment of the anchoring structure 8 which includes two trapping mechanisms 7 housed inside two apertures 14.

Figure 3:
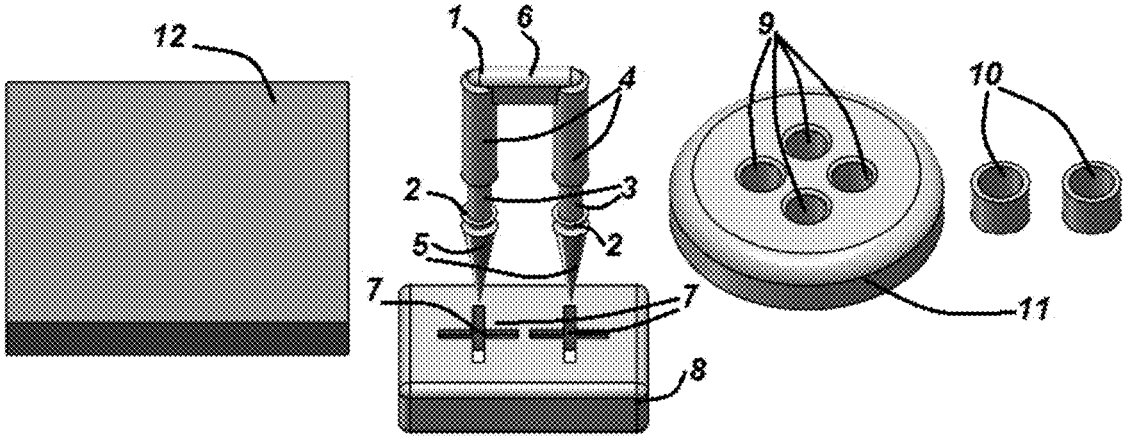
FIG. 3 Illustrates in 3D isometric drawing a top view of an embodiment of the fastening structure, the anchoring structure, the button, the spacing rings and a piece of cloth.

FIG. 3 Illustrates in 3D isometric drawing a top view of an embodiment of the fastening structure 1, the anchoring structure 8, the button 11, the spacing rings 10 and a piece of doth 12 which is used for the demonstration. At the fastening structure 1 the left and right poles (i.e. pole parts 3+4) are positioned vertically and are connected to each other by the horizontal bar 6. The left and right terminal elements 2 are attached to the bottom ends of left and right pole parts 3 respectively. The left and right piercing cones 5 are temporarily attached at their top faces to the bottom faces of the left and right terminal elements 2 respectively. The piercing cones 5 facilitate piercing of the cloth by the terminal elements 2. The cones 5 are configured to be removed by the user after piercing. FIG. 3 also includes a 3D isometric drawing of a top view of an embodiment of the anchoring structure 8 which includes two trapping mechanisms 7 housed inside two apertures 14 which are placed horizontally beneath the fastening structure 1.

Top view of the button 11 is displayed horizontally on the right side of the Fastening structure 1. The buttoning apertures 9 are also depicted. The left and right spacing rings 10 are displayed at the right side of the button 11. A piece of cloth 12 which is necessary for the fastening demonstration is also included on the left.

Figure 4:
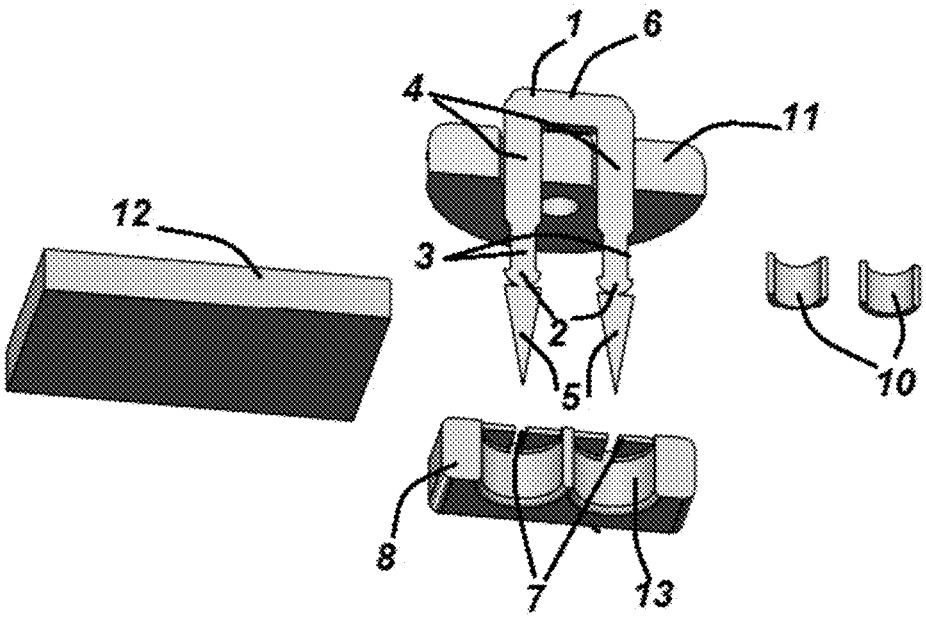
FIG. 4 illustrates in 3D isometric bottom view a cross sectional view of a collection of components required for a button fastening demonstration. The collection includes the fastening structure, the anchoring structure, the spacing rings and the garment cloth.

FIG. 4 illustrates in 3D isometric bottom view a cross sectional view of a collection of components required for a button fastening demonstration. The collection includes the button 11, the fastening structure 1, the anchoring structure 8, the spacing rings 10 and the garment cloth 12. FIG. 4 also includes a cross sectional view of the anchoring structure 8 shown beneath the piercing cones. In FIG. 4, the fastening structure 1 already is inserted into the button 11 apertures 9.

Figure 5:
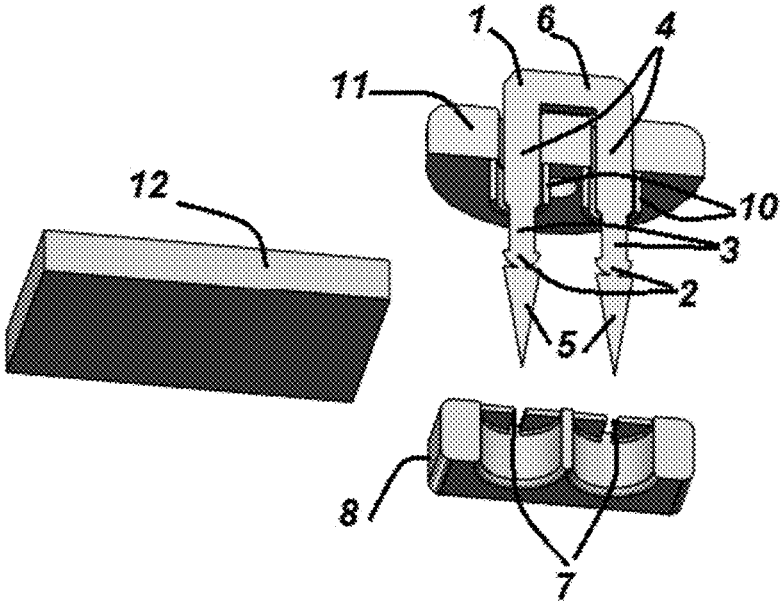
FIG. 5 illustrates in 3D isometric bottom view a cross sectional view of a collection of components required for a button fastening demonstration. The collection includes the fastening structure, the anchoring structure, the spacing rings and the garment cloth.

FIG. 5 illustrates in 3D isometric bottom view of a cross sectional view of a collection of components required for a button fastening demonstration. The collection includes the button 11, the fastening structure 1, the anchoring structure 8, the spacing rings 10 and the garment cloth 12. FIG. 5 also includes a cross sectional view of the anchoring structure 8 shown beneath the piercing cones. In FIG. 5, the fastening structure 1 already was inserted into the button apertures 9 and into the spacing rings 10.

Figure 6:
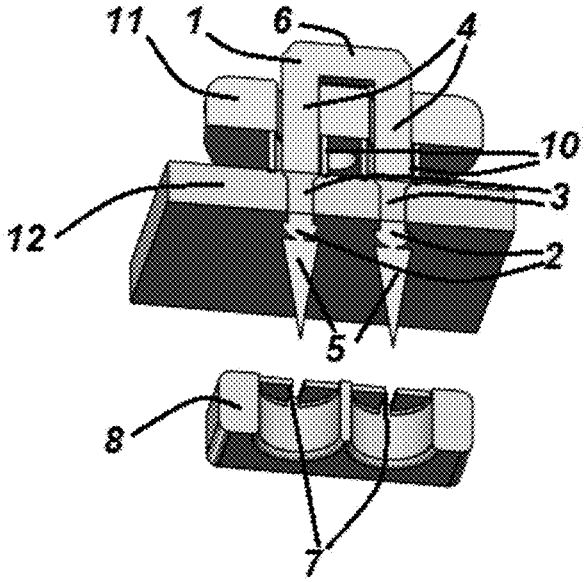
FIG. 6 illustrates in 3D isometric bottom view a cross sectional view of a collection of components required for a button fastening demonstration. The collection includes the fastening structure, the anchoring structure, the spacing rings and the garment cloth.

FIG. 6 illustrates in 3D isometric bottom view a cross sectional view of a collection of components required for a button fastening demonstration. The collection includes the button 11, the fastening structure 1, the anchoring structure 8, the spacing rings 10 and the garment cloth 12. FIG. 6 also includes a cross sectional view of the anchoring structure 8 shown beneath the piercing cones. In FIG. 6, the fastening structure 1 already was inserted into the button apertures 9 and into the spacing rings 10 and already pierced the cloth 12.

Figure 7:
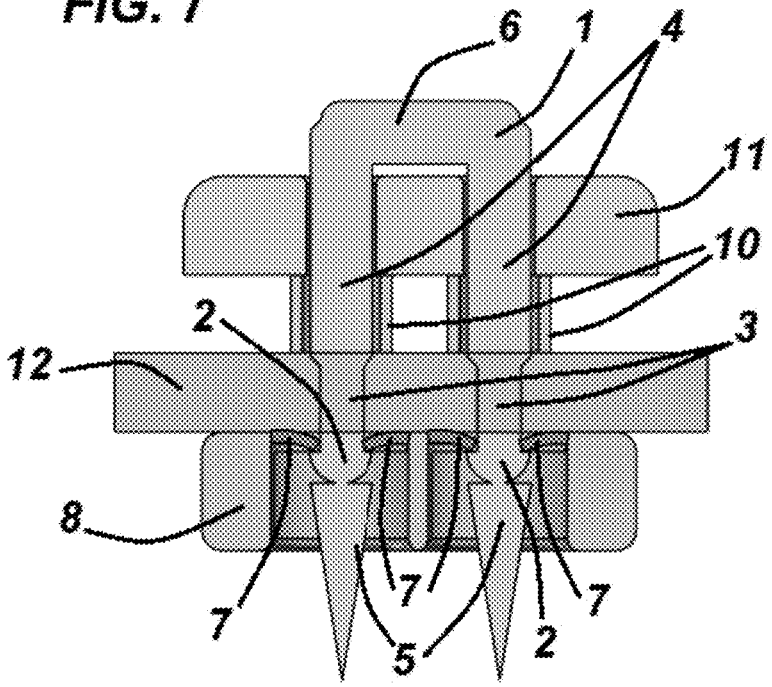
FIG. 7 illustrates in 3D isometric side view a cross sectional view of a collection of components required for a button fastening demonstration. The collection includes the fastening structure, the anchoring structure, the spacing rings and the garment cloth.

FIG. 7 illustrates in 3D isometric side view a cross sectional view of a collection of components required for a button fastening demonstration. The collection includes the button 11, the fastening structure 1, the anchoring structure 8, the spacing rings 10 and the garment cloth 12. FIG. 7 shows the fastening structure already inserted into the button 11 and already pierced the cloth 12 while the spacing rings 10 are already installed beneath the button 11 and above the cloth 12. In FIG. 7 the fastening structure is installed also in the anchoring structure's apertures 13 already activating the trapping mechanisms 7 as well.

Figure 8:
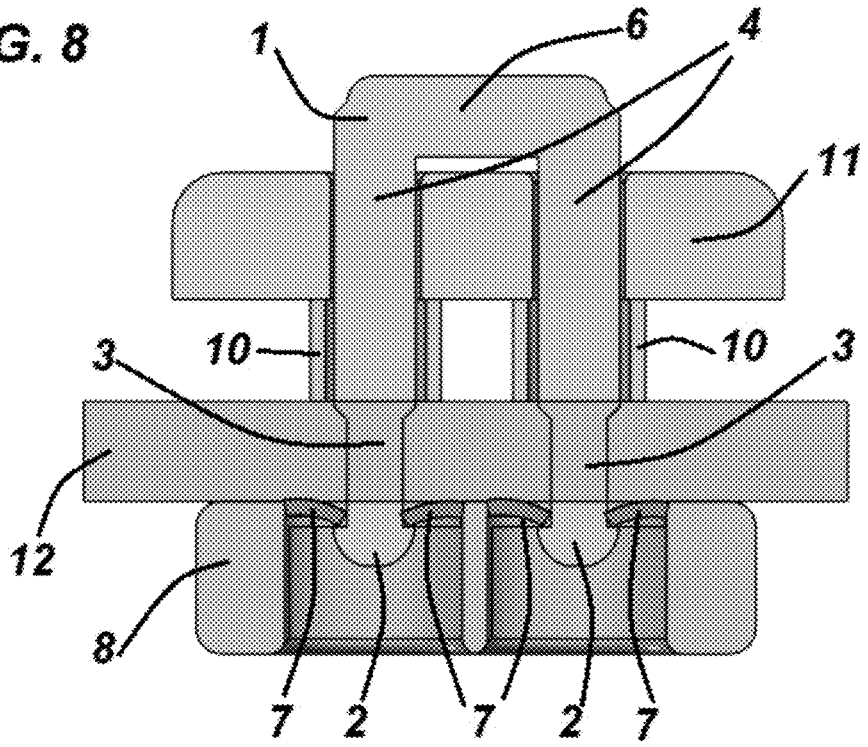
FIG. 8 illustrates in 3D isometric side view a cross sectional view of a collection of components required for a button fastening demonstration. The collection includes the fastening structure, the anchoring structure, the spacing rings and the garment cloth.

FIG. 8 illustrates in 3D isometric side view a cross sectional view of a collection of components required for a button fastening demonstration. The collection includes the button 11, the fastening structure 1, the anchoring structure 8, the spacing rings 10 and the garment cloth 12. FIG. 8 shows the fastening structure already inserted into the button 11 and already pierced the cloth 12 while the spacing rings 10 are already installed beneath the button 11 and above the cloth 12. In FIG. 8 the fastening structure is inserted also in the anchoring structure's apertures 13 and already is activating the trapping mechanisms 7 as well. It can be observed that the resilient flaps 7 are already bent and resting diagonally on the poles 3 above the terminal elements 2. In FIG. 8 the piercing cones 5 were removed as well.

What is claimed is:

1. A button assembly configured for a button fastening on a cloth;

wherein the button assembly comprises: the button, a fastening structure and an anchoring structure;

wherein the fastening structure comprising a left pole, a right pole, a horizontal bar, a left terminal element, a right terminal element, a left spacing ring, and a right spacing ring;

wherein the anchoring structure comprises a left trapping mechanism and a right trapping mechanism;

wherein the button is positioned horizontally and comprises a button's upper surface, a button's lower surface, a left buttoning aperture and a right buttoning aperture;

wherein the left pole is inserted inside the left buttoning aperture and positioned vertically;

wherein the right pole is inserted inside the right buttoning aperture and positioned vertically;

wherein a top end of the left pole is attached to a left end of the horizontal bar;

wherein a top end of the right pole is attached to a right end of the horizontal bar;

wherein the horizontal bar is positioned engaging the button's upper surface;

wherein the left spacing ring is installed on the left pole below the button;

wherein the right spacing ring is installed on the right pole below the button;

wherein a left terminal element's upper side is attached to a bottom end of the left pole;

wherein a right terminal element's upper side is attached to a bottom end of the right pole;

wherein the left terminal element is tied to the button via the left pole which is attached to the horizontal bar;

wherein the right terminal element is tied to the button via the right pole which is attached to the horizontal bar;

wherein the cloth is placed horizontally below the left terminal element and below the right terminal element;

wherein the left trapping mechanism is placed below the cloth and opposite to the left terminal element;

wherein the left trapping mechanism is configured to trap the left terminal element and prevent it from moving upwards when it fully enters the left trapping mechanism;

wherein the right trapping mechanism is placed below the cloth and opposite to the right terminal element;

wherein the right trapping mechanism is configured to trap the right terminal element and prevent it from moving upwards when it fully enters the right trapping mechanism;

wherein the left terminal element when pushed downwards, is configured to pierce the cloth and to enter fully into the left trapping mechanism;

wherein the right terminal element when pushed downwards, is configured to pierce the cloth and to enter fully into the right trapping mechanism;

wherein the button which is tied to the left terminal element and to the right terminal element is configured to be fastened on the cloth when the left terminal element and the right terminal element are pushed downwards and fully enter the left trapping mechanism and the right trapping mechanism respectively.

2. A button assembly of claim 1, wherein the anchoring structure comprises a left anchoring aperture and a right anchoring aperture;

wherein the left anchoring aperture houses the left trapping mechanism;

wherein the right anchoring aperture houses the right trapping mechanism;

wherein the left trapping mechanism is configured to trap the left terminal element inside the left anchoring aperture and to prevent it from moving upwards once the left trapping mechanism is activated; wherein the left trapping mechanism is activated when the left terminal element is fully inserted into the left anchoring aperture;

wherein the right trapping mechanism is configured to trap the right terminal element inside the right anchoring aperture and to prevent it from moving upwards once the right trapping mechanism is activated; wherein the right trapping mechanism is activated when the right terminal element is fully inserted into the right anchoring aperture;

wherein the button is configured to be fastened on the cloth by pushing simultaneously downwards the left pole and the right pole such that the left terminal element and the right terminal element move downwards and are configured to pierce the cloth with the left terminal element and the right terminal element;

wherein pushing the left pole and the right pole even further downwards such that the left terminal element and the right terminal element fully enter the left anchoring aperture and the right anchoring aperture respectively, is configured to activate the left trapping mechanism and the right trapping mechanism thereby trapping the left terminal element in the left anchoring aperture and trapping the right terminal element in the right anchoring aperture;

thereby, the trapped left terminal element and the trapped right terminal element which both are attached to the fastening structure, fasten the button to the anchoring structure and to the cloth.

3. The button assembly of claim 1, wherein a left pole's radius of a left pole's minimal bounding cylinder is smaller than a left terminal element's radius of a left terminal element's minimal bounding cylinder;

wherein a right pole's radius of a right pole's minimal bounding cylinder is smaller than a right terminal element's radius of a right terminal element's minimal bounding cylinder;

wherein the left buttoning aperture and the right buttoning aperture are circular;

wherein the left terminal element's radius and the right terminal element's radius are smaller than a left buttoning aperture's radius and a right buttoning aperture's radius respectively;

wherein a horizontal bar's horizontal length is larger than a minimal distance between the left buttoning aperture and the right buttoning aperture;

wherein the horizontal bar's horizontal length is smaller than a maximal distance between the left buttoning aperture and the right buttoning aperture.

4. The button assembly of claim 1, wherein a left spacing ring's height equals a distance between a left spacing ring's upper side and a left spacing ring's lower side;

wherein a right spacing ring's height equals a distance between a right spacing ring's upper side and a right spacing ring's lower side;

wherein the left spacing ring's height and the right spacing ring's height are configured to be equal;

wherein the left spacing ring's height and the right spacing ring's height are equal to a buttoning spacing;

wherein the buttoning spacing is configured to be larger than a thickness of the doth;

wherein a left spacing ring's aperture radius is configured to be larger than a radius of a left terminal element's minimal bounding cylinder;

wherein a right spacing ring's aperture radius is configured to be larger than a radius of a right terminal element's minimal bounding cylinder.

5. The button assembly of claim 1, wherein the anchoring structure comprises a left anchoring aperture, a right anchoring aperture, a left planar plate and a right planar plate;

wherein the left anchoring aperture has an upper left rim;

wherein the right anchoring aperture has an upper right rim;

wherein the left planar plate and the right planar plate are made of a resilient material;

wherein the upper left rim is entirely attached to the left planar plate;

wherein the upper right rim is entirely attached to the right planar plate;

wherein the left planar plate is divided into a left multiplicity of flaps by a left multiplicity of radial slits which are centered at an upper left rim's center;

wherein the right planar plate is divided into a right multiplicity of flaps by a right multiplicity of radial slits which are centered at an upper right rim's center;

wherein when the left terminal element is pushed downwards through the left multiplicity of flaps via the upper left rim's center, the left multiplicity of flaps is configured to bend and to turn downwards reaching a left bent lowest position;

wherein when the left terminal element's upper side is pushed further downwards below the left bent lowest position, the left multiplicity of flaps is released and is configured to unbend and to turn upwards due to their resiliency until the left multiplicity of flaps end up diagonally resting on the left pole above the left terminal element's upper side;

while the left multiplicity of flaps is diagonally resting on the left pole above the left terminal element's upper side, they are configured to prevent the left terminal element from moving upwards, thereby trapping the left terminal element inside the left anchoring aperture;

when the right terminal element is pushed downwards through the right multiplicity of flaps via the upper right rim's center, the right multiplicity of flaps is configured to bend and to turn downwards reaching a right bent lowest position;

when the right terminal element's upper side is pushed further downwards below the right bent lowest position, the right multiplicity of flaps is released and is configured to unbend and to turn upwards due to their resiliency until the right multiplicity of flaps end up diagonally resting on the right pole above the right terminal element's upper side;

while the right multiplicity of flaps is diagonally resting on the right pole above the right terminal element's upper side, they are configured to prevent the right terminal element from moving upwards, thereby trapping the right terminal element inside the right anchoring aperture.

6. The button assembly of claim 4, wherein a radius of a maximal circle bounded by the left anchoring aperture is larger than a radius of a left terminal element's bounding cylinder by at least a thickness of the left planar plate;

wherein a radius of a maximal circle bounded by the right anchoring aperture is larger than a radius of a right terminal element's bounding cylinder by at least a thickness of the right planar plate.

7. The button assembly of claim 4, wherein a height of a bounding cylinder of the left pole is greater than the sum of a thickness of the button, the buttoning spacing, the thickness of the cloth and a radius of a circle bounding the left aperture;

wherein a height of a bounding cylinder of the right pole is greater than the sum of the thickness of the button, the buttoning spacing, the thickness of the cloth and a radius of a circle bounding the right aperture.

8. The button assembly of claim 1, wherein the button assembly also comprises a left cone and a right cone, which are configured to facilitate piercing of the cloth;

wherein the left cone includes a left cone's upper side and a left cone's lower side;

wherein the right cone includes a right cone's upper side and a right cone's lower side;

wherein the left cone's upper side is flat and the left cone's lower side is pointed;

wherein the right cone's upper side is flat and the right cone's lower side is pointed;

wherein a left terminal element's lower side is connected by a left temporary connection to the left cone's upper side;

wherein the right terminal element's lower side is connected by a right temporary connection to the right cone's upper side;

wherein the left temporary connection and the right temporary connection are configured to be breakable by the user after facilitating piercing of the cloth.

9. The button assembly of claim 1, wherein the left terminal element is configured to have a shape of a left hemisphere; wherein the left hemisphere includes the left terminal element's upper side shaped as a left circular upper plane of the left hemisphere and a left terminal element's lower side shaped as a left hemispherical dome which is connected to the left circular upper plane; wherein the left pole's bottom end is attached to the left circular upper plane;

wherein the right terminal element is configured to have a shape of a right hemisphere; wherein the right hemisphere includes the right terminal element's upper side shaped as a right circular upper plane of the right hemisphere and a right terminal element's lower side shaped as a right hemispherical dome which is connected to the right circular upper plane; wherein the right pole's bottom end is attached to the right circular upper plane.

10. The button assembly of claim 8, wherein the left pole is configured to be cylindrical; wherein a radius of a left pole's circular cross section is configured to be smaller than a radius of the left circular upper plane of the left hemisphere;

wherein the right pole is configured to be cylindrical; wherein a radius of a right pole's circular cross section is configured to be smaller than a radius of the right circular upper plane of the right hemisphere.

11. The button assembly of claim 1, wherein the left terminal element is configured to have a shape of a left cylindrical plate; wherein the left cylindrical plate includes a left terminal element's upper side shaped as a circular upper plane of the left cylindrical plate and a left terminal element's lower side shaped as a lower plane of the left cylindrical plate; wherein the bottom end of the left pole is attached to the circular upper plane of the left cylindrical plate;

wherein the right terminal element is configured to have a shape of a right cylindrical plate; wherein the right cylindrical plate includes a right terminal element's upper side shaped as a circular upper plane of the right cylindrical plate and a right terminal element's lower side shaped as a lower plane of the right cylindrical plate; wherein the bottom end of the right pole is attached to the circular upper plane of the right cylindrical plate.

12. The button assembly of claim 1, wherein a left guiding aperture and a right guiding apertures are drilled in the cloth; wherein the left guiding aperture is located opposite the left terminal element;

wherein the right guiding aperture is located opposite the right terminal element;

wherein the left guiding aperture is configured to facilitate piercing of the cloth by the left terminal element;

wherein the right guiding aperture is configured to facilitate piercing of the cloth by the right terminal element.

13. The button assembly of claim 1, wherein the anchoring structure comprises a left anchoring aperture and a right anchoring aperture;

wherein the left anchoring aperture houses the left trapping mechanism;

wherein the right anchoring aperture houses the right trapping mechanism;

wherein the left aperture includes an upper left opening;

wherein the right aperture includes an upper right opening;

wherein the left trapping mechanism includes a left resilient gate which is configured to facilitate a left unidirectional downwards translation of the left terminal element via the left upper opening into the left aperture;

wherein the left terminal element is configured to move downwards and to push down the left resilient gate;

wherein the left resilient gate is configured to open the left upper opening by bending downwards;

when the left terminal element is pushed downwards through the upper left opening while pushing downwards the left resilient gate, the left resilient gate is configured to bend and to turn downwards reaching a left bent lowest position;

when the left terminal element's upper side is pushed further downwards below the left bent lowest position, the left resilient gate is released and is configured to unbend and to turn upwards due to its resiliency; the left resilient gate is configured to continue unbending and turning upwards until the left resilient gate ends up diagonally resting on the left pole above the left terminal element's upper side;

while the left resilient gate is diagonally resting on the left pole above the left terminal element's upper side, it is configured to prevent the left terminal element from moving upwards, thereby trapping the left terminal element inside the left anchoring aperture;

wherein the right trapping mechanism includes a right resilient gate which is configured to facilitate a right unidirectional downwards translation of the right terminal element via the right upper opening into the right aperture;

wherein the right terminal element is configured to move downwards and to push down the right resilient gate; wherein the right resilient gate is configured to open the right upper opening by bending downwards;

when the right terminal element is pushed downwards through the upper right opening while pushing downwards the right resilient gate, the right resilient gate is configured to bend and to turn downwards reaching a right bent lowest position;

when the right terminal element's upper side is pushed further downwards below the right bent lowest position, the right resilient gate is released and is configured to unbend and to turn upwards due to its resiliency; the right resilient gate is configured to continue unbending and turning upwards until the right resilient gate ends up diagonally resting on the right pole above the right terminal element's upper side;

while the right resilient gate is diagonally resting on the right pole above the right terminal element's upper side, it is configured to prevent the right terminal element from moving upwards, thereby trapping the right terminal element inside the right anchoring aperture.

* * * * *